US006173514B1

(12) United States Patent
Peterson

(10) Patent No.: US 6,173,514 B1
(45) **Date of Patent: *Jan. 16, 2001**

(54) ALL PLASTIC DO-IT-YOURSELF NAME BADGE

(75) Inventor: James P. Peterson, Manitowoc, WI (US)

(73) Assignee: Contemporary, Inc., Manitowoc, WI (US)

( * ) Notice: Under 35 U.S.C. 154(b), the term of this patent shall be extended for 0 days.

This patent is subject to a terminal disclaimer.

(21) Appl. No.: 08/396,005

(22) Filed: Feb. 28, 1995

(51) Int. Cl.[7] ..... A41C 3/00
(52) U.S. Cl. ..... 40/1.5
(58) Field of Search ..... 40/1.5

(56) References Cited

U.S. PATENT DOCUMENTS 584,770 * 6/1897 Datz ..... 40/1.5
3,605,300 * 9/1971 Moore ..... 40/1.5
4,236,331 * 12/1980 Mattson ..... 40/1.5
4,509,277 * 4/1985 Bolton ..... 40/1.5
5,283,966 * 2/1994 Rader et al. ..... 40/1.5
5,305,538 * 4/1994 Kanzelberger ..... 40/616
5,406,726 * 4/1995 Fan ..... 40/1.5 X
5,410,827 * 5/1995 Smith ..... 40/1.5

* cited by examiner

*Primary Examiner*—Terry Lee Melius
*Assistant Examiner*—Andrea Chop
(74) *Attorney, Agent, or Firm*—Laff, Whitesel & Saret, Ltd.; J. Warren Whitesel

(57) ABSTRACT

A solid and unitary plastic block which has a textured strip thereon. A self-adhesive transparent tape may be pressed over the textured strip, with air escaping entrapment behind the tape via depressions in the textured strip. Slots on the end of the textured strip provide a termination for the tape ends.

12 Claims, 5 Drawing Sheets

ALL PLASTIC DO-IT-YOURSELF NAME BADGE

This invention relates to do-it-yourself name badges and more particularly to low cost, all plastic name badges, having a professionally, custom-made appearance.

The term "Name Badge" is used herein to cover all similar devices, such as: plaques, labels, signs, luggage tags, place cards, or the like. The term "textured strip" is used herein for convenience of expression; however, it should be understood that the textured field need not be a strip, but may have any convenient shape. The term "solid and unitary block" is intended to mean a block of plastic, such as one which might be formed by injection molding and which is free of such embellishments as surface films or the like.

Reference is made to U.S. Pat. No. 5,305,538 and to U.S. patent application Ser. No. 08/135,675, filed Oct. 13, 1993, now U.S. Pat. No. 5,398,435, and assigned to the assignee of this invention, for a similar name badge. The two above-identified U.S. patents disclosed a name badge and a kit for making the name badge. The closest known prior art was cited among the references listed in those two patents.

Briefly, these two patents provide very elegant name badges which have an appearance of gold, silver, or the like. The company or person who employs the badges make them by using a small printer which prints graphics on the adhesive side of a transparent, preferably mylar, pressure adhesive tape, somewhat similar to the tape sold under the well-known trademark "SCOTCH". One of the several printers (a "P-printer") that is now available is, perhaps, similar to a small typewriter and is manufactured by the Brother Company. Another and similar printer may be plugged into a printer port of a personal computer. One can imagine that, with the current rate of personal computer development, such a printer may soon produce currently unimaginable graphics.

The person who makes the badge described in the two above-identified patents buys blank plastic plates with accessories similar to those shown in U.S. Pat. Nos. 3,940,864; 4,047,996; 4,267,224; 4,125,655; 4,459,772; and 4,497,248. Each of the purchased badges has a textured surface which prevents an entrapment of air between the transparent tape and the corresponding surface of the purchased plastic badges. The badges described in the above cited two patents have enjoyed great commercial success; however, they are relatively expensive so that they are not feasible for use by, say, attendees at a party or convention, or employees of a fast food restaurant, who often stay for only a few days, weeks, or so.

Therefore, an object of the invention is to extend the principles of the textured badges described in the two above-identified patents into such a low-cost category that they become available for almost any use of name badges. In this connection, an object is to provide the described badges at such a low cost that they may be sold in bags at neighborhood stores such as office product, grocery, drug, convenience, variety stores, and the like.

Another object of this invention is to provide new and improved do-it-yourself means for and methods of making name tags, badges, wall plaques, place cards, and the like, at a very low cost. Here an object is to provide beneficial, high-quality graphics with an almost foolproof system that almost anyone can use in order to produce near-perfect results with little or no special training.

In keeping with an aspect of the invention, blank all-plastic name badge (or the like) panels may be made with a textured strip providing air escape channels on the plastic surface. The channels are provided at very low cost by an injection molding process, where it is possible to provide very accurate surface depressions at no added costs after the molds are made. Logos or similar graphics may be made available by providing hot stamped graphic decals, or self-adhesive labels mounted on a release paper. The only thing required of the user is to have access to a printer which is able to print graphics on the adhesive side of a self-adhering transparent tape.

Preferred embodiments of the invention are shown in the attached drawings, in which.

Figure 4:
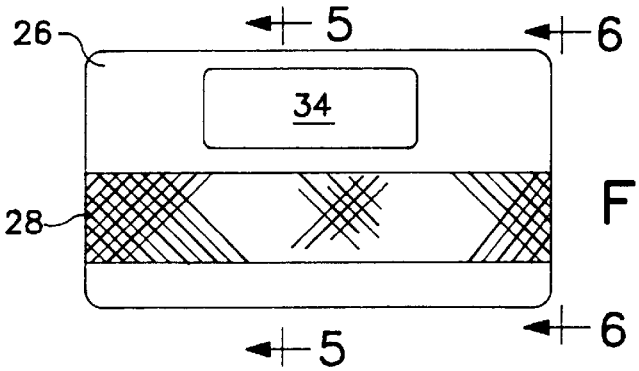
FIG. 4 is a plan view of the inventive name badge plate with a first location for displaying a logo or other graphic location.
Figure 7:
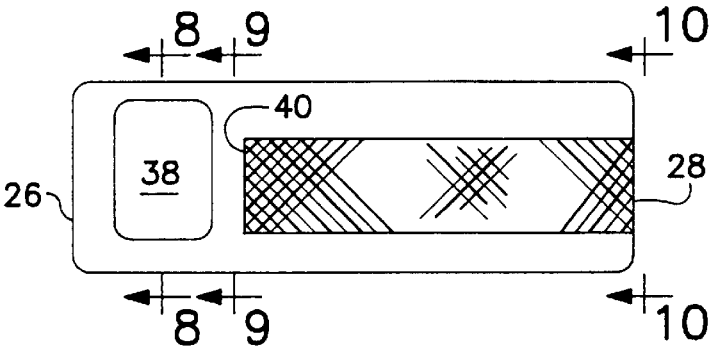
Figure 5:
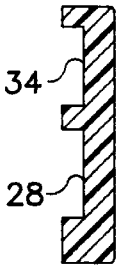
Figure 6:
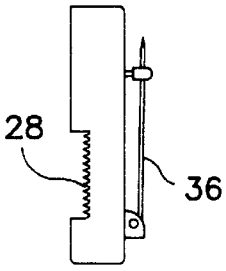
Figure 8:
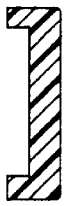
Figure 9:
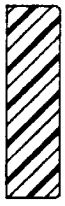
Figure 10:
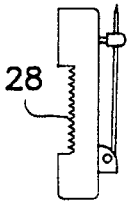
Figure 11:
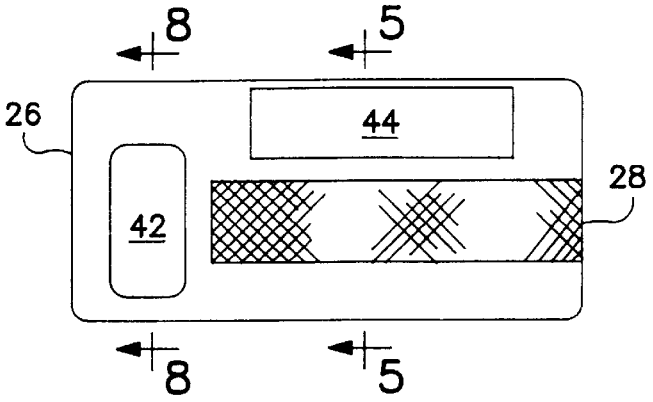
Figure 12:
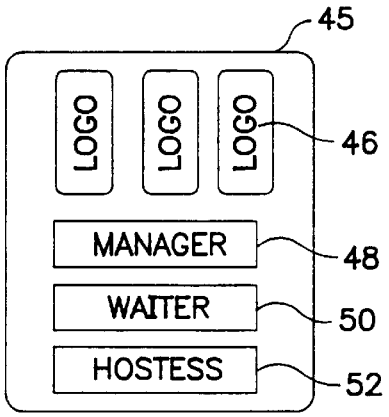
Figure 13:
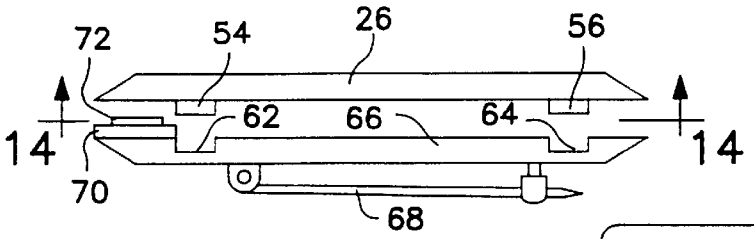
Figure 14:
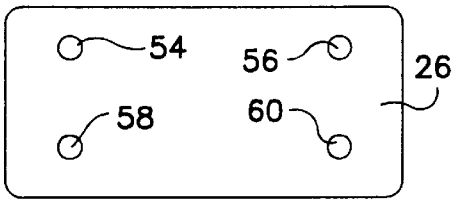
Figure 15:
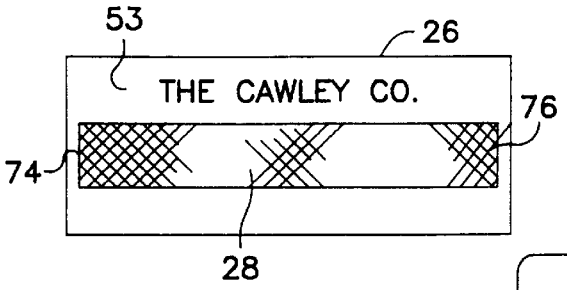
Figure 17:
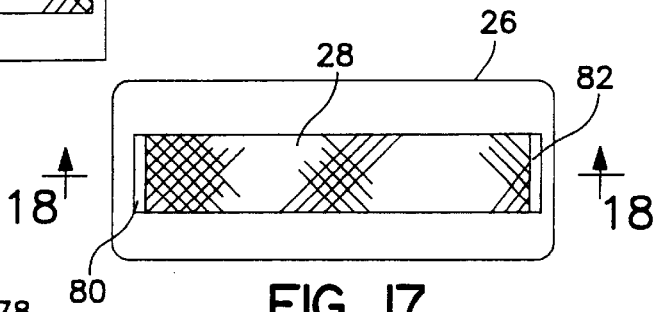
Figure 16:
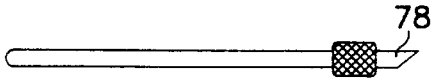
Figure 18:
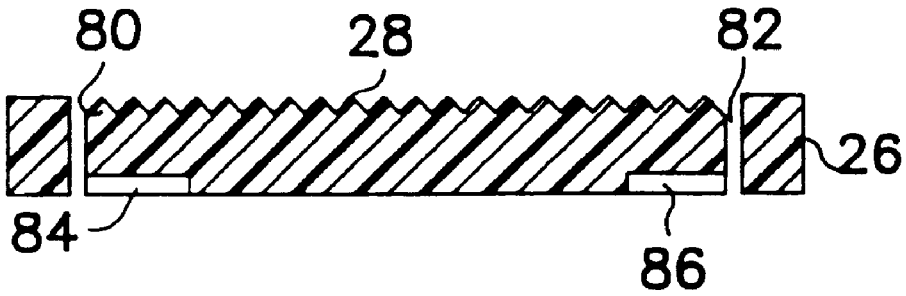
Figure 19:
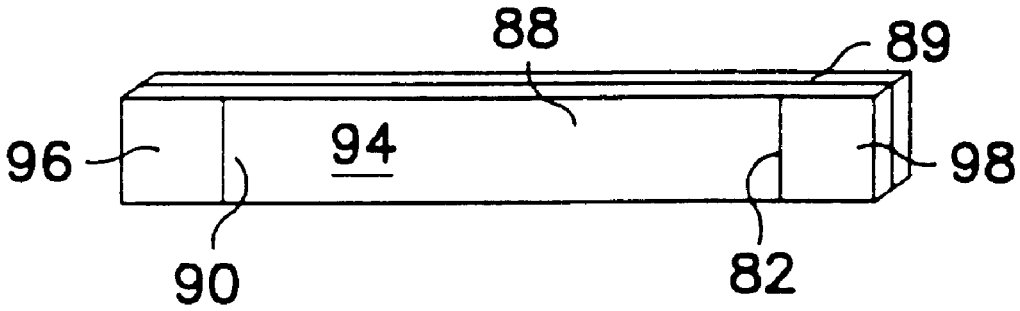
Figure 20:
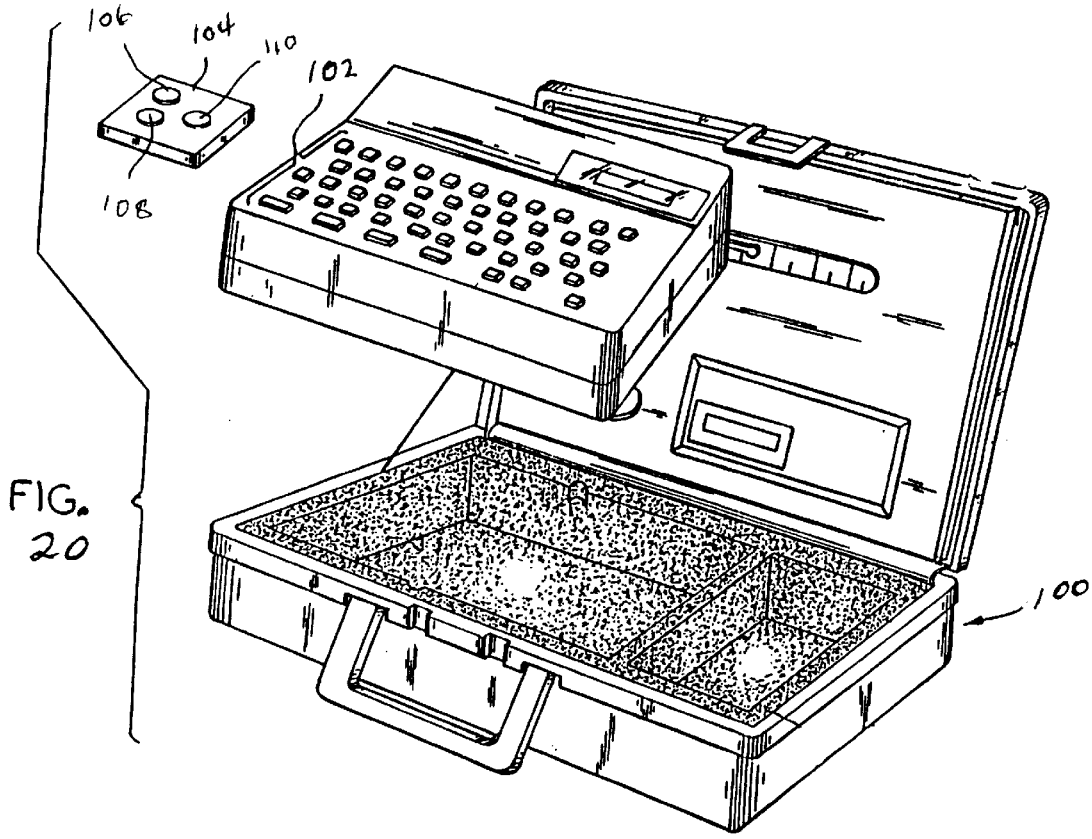
Figure 21:
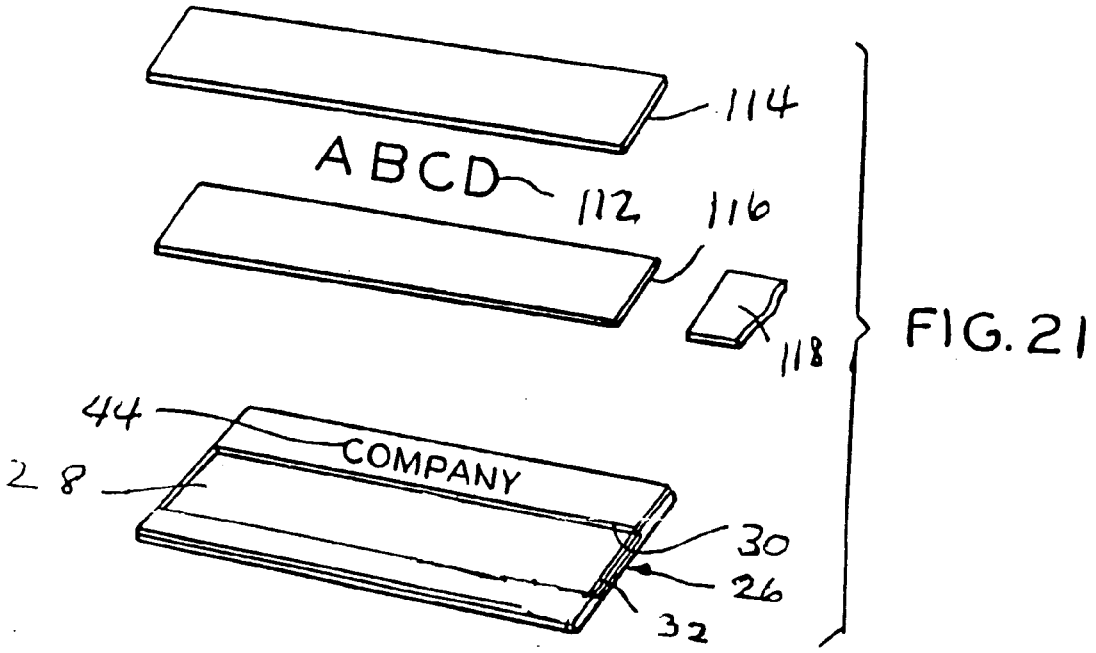

FIGS. 5 and 6 are a cross section and an end view taken at lines 5—5 and 6—6, respectively, of FIG. 4;

FIG. 7 is a plan view of the inventive name badge plate, similar to FIG. 4, but with the graphic display location at a different position on the name badge;

FIGS. 8–10 are cross sections and an end view taken at lines 8—8, 9—9 and 10—10, respectively, in FIG. 7;

FIG. 11 is another plan view of the inventive name badge plate, again similar to FIGS. 4 and 7, but with two locations for graphic display;

FIG. 12 schematically illustrates an example of one way to provide special graphic material for use at the graphic locations in FIGS. 4, 7, 11;

FIG. 13 is a side elevation showing a combination of the inventive name badge plate and a selected one of many findings for the name badge;

FIG. 14 is a plan view of the back of the embodiment of FIG. 13;

FIG. 15 shows an exemplary way of mounting the transparent tape on an all-plastic name badge plate;

FIG. 16 is a knife which may be used to trim the transparent tape after it is mounted on an all-plastic name badge plate of any of the FIGS. 2, 4, 7, 8, 15, or 17;

FIG. 17 shows an all-plastic name badge plate having slots which facilitate an attachment of the tape to the name badge;

FIG. 18 is a cross section taken along line 18—18 of FIG. 17;

FIG. 19 is a plan view of the back of transparent tape that may be used with the plastic name badge of FIG. 17;

FIG. 20 is a perspective view of a printer which is used to make the transparent tape; and FIG. 21 is an exploded view of a tape printed by the printer of FIG. 20, which may be applied to any one of the plastic name plates of FIGS. 2, 4, 7, 8, 15 or 17.

FIGS. 20, 21 are taken from U.S. Pat. No. 5,305,538.

Figure 1:
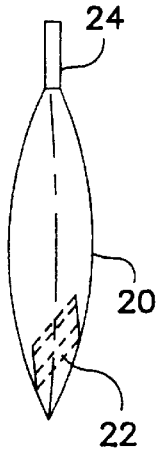
FIG. 1 shows a plastic bag containing a plurality of the inventive all-plastic name plates, in a form which may be sold in neighborhood stores.

FIG. 1 shows, by way of example, a plastic bag 20 containing any suitable number of the inventive plastic name badges, tags, or the like (22) as described hereinafter. The bag may be displayed in any suitable manner at the point of purchase, as by being hung on a rack by a hole formed in a tag end 24. The point of this figure is that the name badges will have such a low cost that they may be sold in any suitable store, such as office products, catalog, neighborhood grocery stores or the like. Of course, the reference to a "plastic bag" is given only for convenience of description. The badges may be packaged in any convenient way—or sold loose, for that matter.

FIGS. 1–12 show the invention in somewhat a step-by-step manner which illustrates how the all-plastic badges may be designed, while FIGS. 13–19 show how the badge may be assembled.

Figure 2:
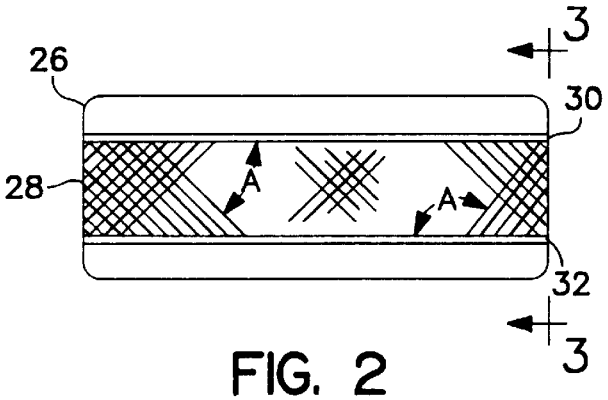
FIG. 2 is a plan view which shows the inventive name badge plate in its simplest form.
Figure 3:
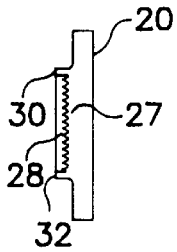
FIG. 3 is an end view taken along line 3—3 of FIG. 2.

More particularly, FIG. 2 shows an all-plastic name plate 26 which may be used to display a finished graphic product in any of many different ways. It could have a pin back for attachment to a lapel, a stand back for setting on a desk, a hanger for hanging on the wall, or any other suitable means for support and display. The plastic plate 26 may have any suitable surface, such as a metallic appearance, or a colored or other surface treatment.

A textured field of any convenient design, here shown as an elongated strip 28 is formed across at least part of the surface of the plastic plate 26 which is normally exposed to view and in the area where the transparent, preferably mylar, tape 27 (FIG. 3) bearing the graphics is to be secured. Without the texture, at least some air would almost certainly be entrapped and distributed under the transparent pressure-sensitive adhesive mylar tape bearing the graphics. There would then be unsightly air bubbles. Even the casual observer, seeing the bubble, would realize that the graphics are little more than a strip of transparent pressure-sensitive tape applied over the surface of the plastic badge.

The textured strip allows air to escape entrapment from under the transparent strip as it is pressed down upon the plate tape. Once the air escapes, the surfaces of the transparent tape and plastic plate may be pressed into such intimate contact that the pressure-sensitive adhesive tape cannot be detected by a normal viewing of the product. The result is that the observer is not aware that he is looking at anything more than the plate 22. If the surface of the plastic plate has a metalized surfaced, gold for example, the total plate would appear to be a gold plate.

The plastic badge is preferably made of any suitable plastic material by an injection molding process. The surface of the textured strip has communicating passageways for allowing the air to escape from under the transparent tape. In a preferred embodiment, cited here by way of example, the texture comprises crossed and spaced parallel lines about 64th of an inch deep and about a 16th of an inch apart. The angle A of the crossed lines is here shown as being in the order of about 30°–60° taken relative to the width dimension of the badge; however, that is not a critical dimension. Other angles may also be used.

Another way of producing a suitable texture is to use an acid to etch the mold in the area of the textured strip. More particularly, first the mold cavity is polished to a mirror finish; then, a tool and die maker's handbook is consulted in order to find a texture having a suitable depth and appearance. From this handbook an acid bath is selected which will cause a randomly-indented surface with communicating depressions which allow air to pass out from under the transparent tape.

The opposite sides 30, 32 of the textured strip 28 have ridges which both serve as a guide for applying the tape to the textured strip and conceal the opposite edges of the tape by, in effect, placing the tape into abutment with the vertical edges of the sides.

In FIG. 4, the all-plastic badge has a depressed window 34 which is of a size and shape that exactly fits a sticker, decal, or the like, which may be placed in the window in order to provide a logo, descriptive title, or the like. The window may also have a textured surface to facilitate an escape of air if the sticker is a thin film which might entrap air.

As shown in FIG. 6, any suitable finding 36 may be provided, depending upon how the all-plastic badge may be displayed. As here shown, a pin back is attached in any suitable manner such as by cement, being molded into the plastic, staked, or heat-sealed in place.

FIG. 7 differs from FIG. 4 in that the window 38 for receiving the sticker, decal, or the like, is on the end of the badge. People may prefer the embodiment of FIG. 4 or FIG. 7 depending upon whether their logo is vertical or horizontal. The textured strip terminates at 40 in a dead end. This may be desired by some people who find it easiest to center and mount the transparent tape over the textured strip 28 by beginning at the dead end 40. Others may prefer the arrangement of FIGS. 2, 4 where the textured strip 28 bleeds to the opposite edges of the badge.

In FIG. 11, there are two windows 42, 44 for receiving a logo, descriptive stickers or decals, or the like.

FIG. 12 shows a release paper 45 with self-adhesive labels 46–52 on it. It is thought that such labels will be relatively sturdy material, such as paper or plastic which will not entrap air. If the labels might entrap air, the underlying badge surface will be textured. If the labels are packaged in the bag 20 (FIG. 1), they will include generic titles such as labels 48–52, which list Manager, Waiter, Hostess, or the like. The "logo" labels 46 may also be generic, such as geometric, patriotic, religious, etc., designs.

The bag 20 may also include a suitable card, such as a return post card, or the like, which a person may return with his logo. The manufacturer will respond by having the logo printed on stickers or decals 46. Or, the postcard could request the manufacturer to hot stamp the badge and deboss the logo therein as shown at 53 (FIG. 15).

FIGS. 13 and 14 show one way of placing a back plate on the all-plastic badge. The back of badge 26 has stakes 54, 56, 58, 60 for receiving corresponding sockets, such as 62, 64 on a finding backing plate 66. The backing plate includes any suitable finding such as pin back 68, tab for insertion into a pocket, clip, or the like. The stakes 54–60 fit into the sockets such as 62, 64 where they may be secured in any suitable manner. For example, badge 26 and backing plate 66 may be cemented together, heat-sealed, or joined by a self-adhesive layer when a suitable release paper 22 is removed. Depending upon the plastic used, friction alone may be enough to join the badge 26 and backing plate 66.

FIGS. 15 and 16 show a way which may be used to apply the transparent tape to any of the name badges. In FIG. 15, the textured strip 28 has two dead ends at 74, 76. The transparent tape is placed over and in contact with the textured strip 28. The ends of the transparent tape extend beyond the textured strip 28. Therefore, a knife 78 (FIG. 16) is used to trim the transparent tape at the ends 74, 76 of the textured strip. Then, the selvage extending beyond ends 76, 76 is peeled away and discarded.

In FIGS. 17, 18, the textured strip 28 ends in two slots 80, 82 so that the ends of the transparent tape may be inserted through the slots, pulled around the back of the all-plastic badge 26 and pressed down into recesses 84, 86. The knife 78 may be used to cut off the ends of the transparent tape at the ends of recesses 84, 86. Again, the selvage is then discarded.

FIG. 19 shows the release paper 88 at the back of the transparent tape 89. The printer creates score lines 90, 92 near the end of the release paper. Therefore, by peeling the release paper off the center section 94, the pressure-sensitive, self-adhesive tape exposed by the peeled section 94 may be pressed over the textured strip 28. The remaining release paper 96, 98 forms two tabs on opposite ends of the tape, which facilitates the insertion of the tape ends into and through the slots 80, 82. Once the tabs are free at the back of the all-plastic badge 26, the release paper 96, 98 is pulled off and the transparent tape is pressed into recesses 84, 86.

FIG. 20 shows a commercial printer 100 which is available to the person who buys the all-plastic badges. If that person makes many badges (such as at a church, school, or convention center, for example), he may own the printer. If the badges are purchased through, say a party-time supply store, it may own the printer. Other people may already own the printer which is basically a label maker.

The printer 100 may take many different forms; however, one example of a suitable printer which produces excellent results is a Brother "P-Touch" printer. This printer has a conventionally-arranged typewriter keyboard 102 which may be used to enter any suitable alpha-numerical characters. A cassette 104 in the printer contains three spools 106, 108, 110, respectively, carrying a transparent mylar tape, a double-sided adhesive tape, and a release tape. During printing, these three tapes are assembled within the printer. The printer 100 prints alpha-numerical characters 112 (FIG. 21) on the back of the mylar tape 114, attaches a double-sided adhesive tape 116 over the printing and onto the back of mylar tape 114, and then places release paper 118 over the adhesive tape 116. Then, the printed length of the assembled printed tape is ejected from the printer and cut off. A score line (not shown in FIG. 21) may be formed in the release paper to facilitate a peeling of the release paper 118 from the adhesive tape 116.

The printer contains firmware which generates different graphics. For example, one cassette may generate Roman letters, another may generate old English letters, and yet another could generate Greek letters, mathematical, and scientific symbols, or the like. The user may select any suitable ones of these character generator cassettes, as he sees fit.

Once the release paper 118 is removed, the tape 114/116 is pressed on over the textured strip 26, with the otherwise entrapped air escaping through the communicating passageways formed by the texture. The edges 30, 32 help align the tape during the process of attaching it to the name badge. If the window (FIG. 4), for example, is provided, a suitable sticker or decal (FIG. 12) is placed in it. Also, the printer 100 may have a cassette which prints out a suitable picture of a flower, teddy bear, a patriotic or religious symbol, or the like, depending upon the graphics in the cassette that is used.

Those who are skilled in the art will readily perceive how to modify the invention. Therefore, the appended claims are to be construed to cover all equivalent structures which fall within the true scope and spirit of the invention.

The claim invention is:

1. A name badge comprising a solid and unitary block forming an all-plastic plate having front and back surfaces with a textured strip area on said front surface of said unitary block which is normally exposed to view, said textured area being in a restricted field having dimensions corresponding to dimensions of a transparent tape, said textured area having communicating depressions therein for enabling air to escape through said depressions, a transparent tape having graphic material thereon which is viewed through a front surface of said tape, a pressure-sensitive adhesive on the back of said tape, said air escaping through said depressions as said pressure-sensitive adhesive as pressed over said textured surface, and said back surface of said unitary all-plastic plate being exposed to view.

2. The name badge of claim 1 wherein said texture comprises two fields of spaced parallel score lines, the score lines in said two fields crossing each other.

3. The name badge of claim 2 wherein said score lines form an angle in the range of about 30°–60° taken with respect to a width of said badge.

4. The name badge of claim 1 and means for displaying a graphic design on said badge.

5. The name badge of claim 4 wherein said means for displaying a graphic design is a depressed window shaped to receive a sticker carrying said design.

6. The name badge of claim 1 and means for attaching a finding to said badge.

7. The name badge of claim 6 wherein said means for attaching said finding comprises a plurality of posts formed on a back of said name plate, and said finding comprises a separate plate having openings which fit over said posts.

8. The name badge of claim 1 wherein said textured area is an elongated strip extending across a width on a surface of said name badge, said strip terminating on opposite ends of said width in slots extending through said name badge, and a spatial relationship between said transparent tape and said slots being such that ends of said tape may pass through said slots and be secured to a back of said name badge while the graphics material is pressed onto said textured strip.

9. A name badge comprising a solid and unitary block forming an all-plastic plate having a textured area on a front surface of said unitary block which is normally exposed to view, said textured area having communicating depressions therein for enabling air to escape through said depressions, a transparent tape having graphic material thereon which is viewed through a front of said tape, a pressure-sensitive adhesive on the back of said tape, said tape having dimensions which fit said textured area, said air escaping through said depressions as said pressure-sensitive adhesive as pressed over said textured surface, said textured area being in a restricted field comprising an elongated stripe extended across a width of said front surface, said stripe terminating on opposite ends of said width in slots extending through said name badge, a spatial relationship between said transparent tape and said slots being such that ends of said tape may pass through said slots and be secured to a back of said name badge while the graphics material is pressed onto said textured strip, and a release paper secured to the adhesive on the back of said tape, a space between a pair of score lines on said release paper being at locations coinciding with said width of said stripe whereby said release paper between said score lines may be removed so that said tape with said graphics may be adhered to said elongated textured stripe while the release paper may remain at the ends of said transparent tape in order to provide tabs for insertion through said slots.

10. The name badge of claim 9 and recessed portions on the back of said name badge to receive the tab ends of said transparent tape after the release paper has been peeled away from the tab ends of said tape.

11. A system for displaying graphic material on a solid and unitary block of plastic, said system comprising a textured stripe on a display side of said solid and unitary plastic block, a thin strip of transparent self-adhesive tape having dimensions which fit onto said textured stripe, said texture comprising communicating depressions which enable air to escape from between said tape and said textured stripe, means for applying graphic material to the side of said transparent tape having said self-adhesive thereon whereby said graphic material is visible through said tape, means for applying a finding to said solid and unitary plastic block, and means for providing release paper on tab ends of said transparent tape in order to provide tabs for assisting said tape to pass through said slots.

12. The system of claim 11 and recesses on the back of said solid and unitary plastic block for receiving said tab ends of said tape after said release paper is removed therefrom.

* * * * *